US006634179B2

(12) United States Patent
Heinemann et al.

(10) Patent No.: US 6,634,179 B2
(45) Date of Patent: Oct. 21, 2003

(54) PROCESS AND CONFIGURATION FOR PRODUCING WEAR-RESISTANT SURFACES

(75) Inventors: Rolf Heinemann, Lehre (DE); Klaus Färber, Gifhorn (DE); Thomas Heider, Wolfsburg (DE)

(73) Assignee: Volkswagen AG, Wolfsburg (DE)

( * ) Notice: Subject to any disclaimer, the term of this patent is extended or adjusted under 35 U.S.C. 154(b) by 9 days.

(21) Appl. No.: 09/933,051

(22) Filed: Aug. 20, 2001

(65) Prior Publication Data

US 2002/0012753 A1 Jan. 31, 2002

Related U.S. Application Data

(63) Continuation of application No. PCT/EP00/00575, filed on Jan. 26, 2000.

(30) Foreign Application Priority Data

Feb. 19, 1999 (DE) ..... 199 07 104
Sep. 1, 1999 (DE) ..... 199 41 562

(51) Int. Cl.[7] ..... C25D 25/00; C21D 9/08; B05D 1/08; C23C 4/00

(52) U.S. Cl. ..... 62/62; 427/446; 148/524

(58) Field of Search ..... 62/62, 434; 427/455, 427/446; 148/525

(56) References Cited

U.S. PATENT DOCUMENTS 4,175,503 A * 11/1979 Ernest ..... 123/41.72
4,191,238 A * 3/1980 Pichl ..... 164/100
5,271,967 A 12/1993 Kramer et al.
5,732,671 A * 3/1998 Takami et al. ..... 123/193.2
5,795,659 A * 8/1998 Meelu et al. ..... 428/610
6,112,804 A * 9/2000 Sachs et al. ..... 164/348
6,349,681 B1 * 2/2002 Li ..... 123/41.74
6,427,754 B1 * 8/2002 Ozcan ..... 164/95

FOREIGN PATENT DOCUMENTS

| | | |
|---|---|---|
| DE | 27 39 356 | 3/1979 |
| DE | 38 08 285 A1 | 9/1989 |
| DE | 196 43 029 A1 | 4/1998 |
| DE | 197 40 205 A1 | 3/1999 |
| EP | 0 837 152 A1 | 4/1998 |
| JP | 61-231155 A | 10/1986 |
| JP | 3-173758 | 7/1991 |
| JP | 3-236460 | 10/1991 |
| JP | 4-72051 | 3/1992 |
| JP | 4-358056 | 12/1992 |

* cited by examiner

*Primary Examiner*—William C. Doerrler
(74) *Attorney, Agent, or Firm*—Laurence A. Greenberg; Werner H. Stemer; Manfred Beck

(57) ABSTRACT

A wear-resistant surface is formed on a component formed of an AlSi alloy by using a thermal spraying or a laser beam treatment. A thermally conductive device is brought into a thermally conductive contact with the component so that the thermally conductive device touches the component during the step of forming the wear-resistant surface. The thermally conductive device is actively cooled.

22 Claims, 1 Drawing Sheet

PROCESS AND CONFIGURATION FOR PRODUCING WEAR-RESISTANT SURFACES

CROSS-REFERENCE TO RELATED APPLICATION

This application is a continuation of copending International Application No. PCT/EP00/00575, filed Jan. 26, 2000, which designated the United States.

BACKGROUND OF THE INVENTION

Field of the Invention

The invention relates to a process for producing wear-resistant surfaces on components made from an AlSi alloy. The invention also relates to a configuration for producing wear-resistant surfaces on components made from an AlSi alloy.

Hypoeutectic aluminum-silicon alloys, which are predominantly used for cylinder crankcases, are unsuitable for the tribological loads of the piston/piston ring/cylinder bearing surface system, because of an insufficient level of the wear-resistant silicon phase. Hypereutectic alloys, e.g. the alloy $AlSi_7Cu_4Mg$ have a sufficient number of silicon crystallites. This hard, wear-resistant microstructure constituent is raised with respect to the matrix formed of an aluminum mixed crystal by chemical and/or mechanical processing stages and forms a required load-bearing surface component. However, drawbacks are the castability, which is low compared to the hypoeutectic and almost eutectic alloys, poor machinability and the high costs of this alloy.

One possible way of avoiding these drawbacks is to cast in sleeves or liners made from a wear-resistant material, such as for example gray cast iron and hypereutectic aluminum alloys. However, a problem in this case is the join between the sleeve and the surrounding casting, because the join is achieved merely by mechanical meshing or interlocking. When using a porous ceramic liner material, it is possible to infiltrate the liner material during the casting process and thus to obtain a material-to-material bond. This requires a slow filling of the casting mold and the use of high pressure, which considerably reduces the economic efficiency of the process.

Alternatively, hypoeutectic and almost eutectic alloys of electrodeposition coatings are applied directly onto the cylinder bearing surfaces. However, this is expensive and these coatings cannot sufficiently withstand tribochemical loads. A further alternative are thermally sprayed layers, which are likewise applied directly to the cylinder bearing surfaces. However, the adhesive strength of these layers is insufficient, since they are joined only by a micromechanical interlocking.

Therefore, it has already been proposed to carry out the surface modifications of remelting, alloying, dispersing and coating by using a laser, as is disclosed, for example, in Published, Non-Prosecuted German Patent Application No. DE 196 43 029 A1. In this case, it is necessary to sufficiently dissipate the energy which is introduced into the crankcase or the cylinder bearing surfaces by the laser beams. The dissipation of energy is necessary because an excessively high input of heat with high-energy laser beams may lead to undesirable changes to the microstructure in the crankcase. For this purpose, Published, Non-Prosecuted German Patent Application No. DE 196 43 029 A1 has already proposed that the component surface be cooled via cooling-water channels of the crankcase.

SUMMARY OF THE INVENTION

It is accordingly an object of the invention to provide a process and a configuration for producing a wear-resistant surface on a component which overcome the above-mentioned disadvantages of the heretofore-known processes and configurations of this general type and which allow components to be coated even with high-energy coating devices, such as high-performance lasers, without causing heat-related changes to the material of the component.

With the foregoing and other objects in view there is provided, in accordance with the invention, a process for producing a wear-resistant surface on a component, the process includes the steps of:

providing a component formed of an AlSi alloy;

forming a wear-resistant surface on the component by using a thermal spraying or a laser beam treatment; and bringing at least one thermally conductive device into a thermally conductive contact with the component such that the at least one thermally conductive device touches the component during the step of forming the wear-resistant surface; and actively cooling the at least one thermally conductive device.

In other words, a process for producing wear-resistant surfaces on components made from an AlSi alloy is provided, wherein the wear-resistant surfaces are applied by thermal spraying or a laser beam, wherein, during the production of the wear-resistant surface, at least one thermally conductive device is brought into a thermally conductive contact with the component, and wherein this thermally conductive device is actively cooled.

The above-defined process has the advantage that a good dissipation of heat in combination with an increased cooling capacity is available during the coating operation, so that in particular a laser alloying and a laser coating can be carried out without the risk of a heat-related change in the structure of the material of the crankcase. This allows to carry out a coating at even higher energies, so that, for example, a greater depth of penetration of the coating material into the material of the component, a better join or connection between the coating and the material of the component and/or a greater layer thickness are achieved.

To further improve properties of the coating that is applied, after the formation of the wear-resistant surface in the form of a thermally sprayed layer, this layer is additionally treated with a laser beam. In particular, the layer is remelted with a laser beam.

As explained, the wear-resistant surface may be applied through the use of a thermal spraying, in particular a flame spraying, a plasma spraying or a HV (high velocity) spraying, or through the use of a laser beam.

According to a preferred mode of the invention, a remelting, alloying, dispersing and/or coating is carried out through the use of a laser beam or by thermal spraying.

The component, whose surface is to be treated, is for example a crankcase of a reciprocating internal combustion engine. The coating is to be carried out on cylinder bearing surfaces of cylinders of the crankcase. In this case, according to a preferred mode of the invention, during the production of the wear-resistant surface, a water space or water chamber of the crankcase has a cooling medium, in particular gas, nitrogen or a cooling liquid, flowing through it.

According to another mode of the invention, the thermally conductive device or heat-conducting device includes at least one cooling plate with passages for a cooling medium. The at least one cooling plate is put against the crankcase on at least one side on which open ends of the cylinders are situated.

According to yet another mode of the invention, the thermally conductive device includes at least one cooling mandrel which is formed such that it corresponds to the cross section of the cylinder and which is brought into contact with the cylinder bearing surface. The at least one cooling mandrel follows a coating zone on the cylinder bearing surface in an axial direction of the cylinder and/or trails the coating zone.

According to a further mode of the invention, the thermally conductive device includes a cooling-medium tank, into which the crankcase is dipped during the production of the wear-resistant surface, in such a manner that a cooling-medium level in the cylinder remains below a coating zone as seen in the direction of the force of gravity. In this case, an immersion depth, i.e. a depth to which the crankcase is dipped into the cooling-medium tank, is controlled in such a manner that a constant given distance is maintained between the coating zone and the cooling-medium level.

According to yet a further mode of the invention, the active cooling of the thermally conductive device is carried out by using a gas, nitrogen and/or a cooling liquid.

According to an advantageous mode of the invention, a honing operation is performed subsequent to the coating process according to the invention, in order to smooth the coated surface.

With the objects of the invention in view there is also provided, a configuration for producing a wear-resistant surface on a component, including:

a thermally conductive device configured to be disposed in a thermally conductive contact with a component formed of an AlSi alloy; and the thermally conductive device being configured to operate with a cooling medium.

In other words, a configuration for producing wear-resistant surfaces on components made from an AlSi alloy, in particular on cylinder bearing surfaces of cylinders of a crankcase of a reciprocating internal combustion engine, includes a thermally conductive device which is disposed in a thermally conductive contact with the component and includes a cooling medium.

This has the advantage of a good dissipation of heat with an increased cooling capacity during the coating operation, so that in particular a laser alloying and a laser coating can be carried out without the risk that the heat causes a change in the structure of the material of the crankcase. Consequently, it is possible to carry out a coating using even higher energy levels, so that, for example, an increased depth of penetration of the coating material into the material of the component, a better join between the coating and the material of the component and/or a higher layer thickness are achieved.

The cooling medium expediently includes a gas, nitrogen and/or a cooling liquid, which have a high coefficient of heat capacity to ensure a correspondingly high dissipation of heat.

According to a preferred embodiment of the invention, the thermally conductive device includes at least one cooling plate with passages through which the cooling medium flows, wherein a cooling plate is disposed on the crankcase on at least one side of the crankcase where the cylinders have their open ends.

According to another feature of the invention, the thermally conductive device includes an annular cooling plate that is shaped such that it rests on a circumferential edge of a corresponding cylinder bore and such that it is aligned with the cylinder bore, i.e. it is in line with the cylinder bore. Thus a good dissipation of heat is achieved at the circumference of the cylinder bore.

According to another preferred embodiment of the invention, the thermally conductive device includes at least one cooling mandrel which is formed such that it corresponds to the cross section of a cylinder bore. The at least one cooling mandrel has passages through which the cooling medium flows. The at least one cooling mandrel is, in the axial direction of the cylinder, disposed on at least one side of a coating zone, i.e. the at least one cooling mandrel is disposed on one side or on both sides of a coating zone, in such a manner that a thermally conductive contact is formed between the at least one cooling mandrel and the cylinder bearing surface.

In order to achieve a high cooling capacity in the vicinity of the cylinder bearing surface, the passages through which the cooling medium flows are helical passages so that the cooling medium flows in a helically encircling manner.

In order to collect excess coating material, a cooling mandrel which is disposed beneath the coating zone, as seen in the direction of the force of gravity, is configured to have a collection basin for excess coating material.

In order to collect excess coating material and to introduce it into the collection basin, a collection lug or protrusion is formed on a side of the periphery of the cooling mandrel that faces the coating zone.

In order to increase the cooling action of the cooling mandrel, the cooling mandrel is formed, on its periphery which faces the cylinder bearing surface, with cooling bristles which are in brushing contact with the cylinder bearing surface. The cooling bristles are expediently made from a thermally conductive material, in particular copper.

According to another embodiment of the invention, the thermally conductive device includes at least one cooling-medium tank, into which the component can be dipped in such a manner that a cooling-medium level is at a given distance from a coating zone.

With the objects of the invention in view there is also provided, in combination with a component formed of an AlSi alloy, a configuration for treating the component, including:

a thermally conductive device including a cooling medium; and the thermally conductive device being in a thermally conductive contact with the component.

According to another feature of the invention, the component is a crankcase having a cylinder with a cylinder bearing surface, and the thermally conductive device is in a thermally conductive contact with the cylinder bearing surface.

According to yet another feature of the invention, the cooling medium is a gas or a cooling liquid.

According to a further feature of the invention, the crankcase has a side formed with a cylinder opening, the thermally conductive device has a cooling plate disposed on the side formed with the cylinder opening, and the cooling plate is formed with channels for the cooling medium to flow therethrough.

According to yet a further feature of the invention, the cylinder is formed with a cylinder bore having a circumferential edge, the thermally conductive device has an annular cooling plate disposed along the circumferential edge and aligned with the cylinder bore, and the at least one annular cooling plate is formed with channels for the cooling medium to flow therethrough.

According to another feature of the invention, the cylinder has a cross section and has a coating zone on the cylinder bearing surface, the thermally conductive device includes a cooling mandrel formed to correspond to the cross section of the cylinder, the cooling mandrel is disposed in the cylinder on at least one side of the coating zone such that the thermally conductive contact is formed between the cooling mandrel and the cylinder bearing surface, and the cooling mandrel is formed with passages for the cooling medium to flow therethrough.

According to yet another feature of the invention, the passages are helical passages.

According to a further feature of the invention, the cooling mandrel is disposed, with respect to a direction of gravity, beneath the coating zone, and the cooling mandrel has a collection basin for receiving excess coating material.

According to an additional feature of the invention, the cooling mandrel has a peripheral region with a side facing the coating zone, and the cooling mandrel has a collection lug disposed on the side of the peripheral region facing the coating zone.

According to another feature of the invention, the cooling mandrel has a peripheral region facing the cylinder bearing surface, and the cooling mandrel has cooling bristles disposed at the peripheral region, and the cooling bristles are in brushing contact with the cylinder bearing surface.

According to another feature of the invention, the component has a coating zone, the thermally conductive device includes a cooling-medium tank filled with the cooling medium up to a cooling medium level, and the component is dipped into the cooling medium such that a given distance between the cooling-medium level and the coating zone is maintained.

Other features which are considered as characteristic for the invention are set forth in the appended claims.

Although the invention is illustrated and described herein as embodied in a process and a configuration for producing wear-resistant surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
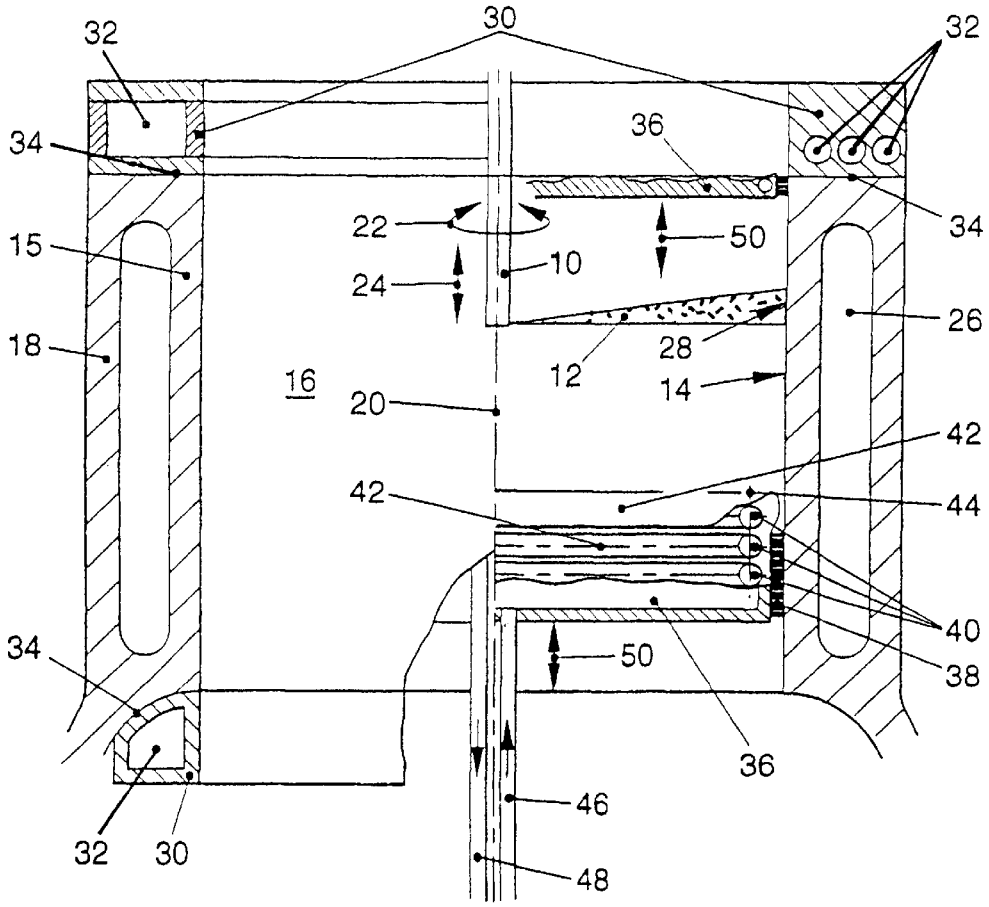
FIG. 1 is a diagrammatic, partial sectional view of a preferred embodiment of a configuration according to the invention, which implements three embodiments for an additional cooling of a component.

Referring now to the figures of the drawings in detail and first, particularly, to FIG. 1 thereof, there is shown a preferred embodiment of a configuration according to the invention which includes a coating device 10. The coating device 10 coats a cylinder bearing surface 14 of a cylinder wall 15 of a cylinder 16 of a crankcase 18 through the use of a plasma jet or plasma beam 12 which is, for example, a laser beam. The coating device 10 can rotate about a longitudinal axis 20, as indicated by arrow 22, and can be displaced along the longitudinal axis 20, as indicated by arrow 24. The crankcase 18 has a water chamber or water space 26 for a cooling medium. The rotary movement and translational movement of the coating device 10 relative to the cylinder wall 15 allows the cylinder bearing surface 14 to be treated in predetermined regions. In the following, a current working region of a coating device 10, in which the plasma beam 12 or a laser beam is incident on the cylinder bearing surface 14, is referred to as a working zone or a coating zone 28.

According to the invention, the configuration includes a cooling plate 30, which is produced in constructed form, i.e. the cooling plate 30 is produced through the use of a system of plates, or is produced mechanically, or is produced in cast form, and includes cooling passages 32 through which the cooling medium flows. In this way, the cooling plate is actively cooled and, over and beyond simple heat conduction, actively dissipates thermal energy. The cooling passages are, for example, rectangular and/or round in cross section and are formed in particular above a contact surface 34 between cooling plate 30 and cylinder wall 15. A cooling plate 30 is disposed on either one or both sides of the open ends of the cylinder 16. Furthermore, the cooling plates have an annular shape so that they correspond to the cylinder cross section and so that they rest on the peripheral cylinder wall 15. By being annular-shaped or ring-shaped, the cooling plates provide an opening for inserting the coating device 10 into the cylinder. The lower cooling plate 30 in FIG. 1, which has an annular design, has the further advantage that process gases and excess coating material which has not melted or adhered to the cylinder bearing surface 14 can be discharged in the direction of the force of gravity, i.e. downward in FIG. 1.

According to the invention, the configuration also includes a cooling mandrel 36 which is configured in a way so that it corresponds to the cross section of the cylinder 16, so that that the cooling mandrel 36 can be introduced into the cylinder 16, where it bears against the cylinder wall 15 in the circumferential direction. Alternatively or additionally to the configuration according to which the cooling mandrel 36 bears directly against the cylinder wall 15, cooling bristles 38, for example made from copper, are provided on the lateral surface of the cooling mandrel 36. These cooling bristles are in contact with the surface of the cylinder wall 15 and, in this way, dissipate heat from the cylinder wall 15 to the cooling mandrel 36. Furthermore, cooling passages 40, through which a cooling medium flows and which are used for an active cooling and a dissipation of thermal energy as described above, are provided in the cooling mandrel. The cooling passages are formed so that they extend in a helically encircling manner.

Particles which do not adhere to the cylinder wall 15 are collected through the use of a collection basin 42 formed on the lower cooling mandrel 36, as shown in FIG. 1. The collection basin 42 is expediently also filled with a cooling medium. An additional collection lug 44 guides excess coating material which drops off into the collection basin 42. A cooling-medium inlet 46 and a cooling-medium outlet 48 are provided for the cooling medium in the collection basin 42 and/or in the cooling passages 40. According to the invention, one or both of the cooling mandrels 36 illustrated in FIG. 1 are moved along in the direction of arrow 24 at the rate of advance of the coating device, as indicated by arrow 50.

In addition, in order to smooth the coated surface, it is possible to hone the coating wherein a plurality of steps may be used for the honing operation depending on the surface quality.

Figure 2:
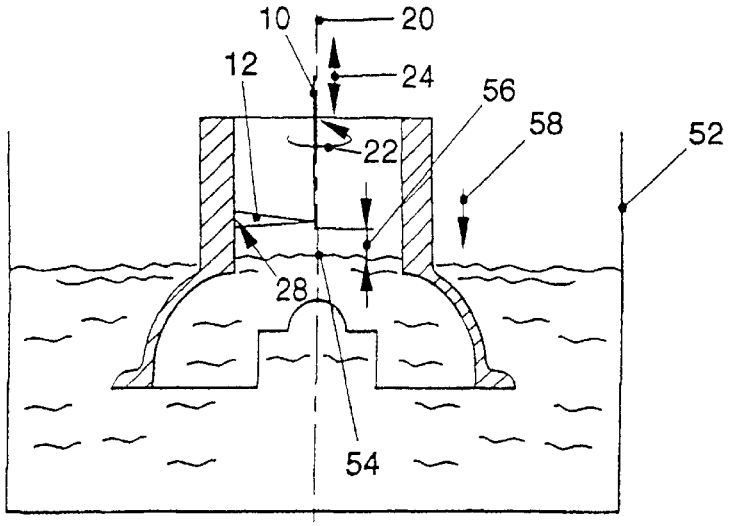
FIG. 2 is a diagrammatic sectional view of a further preferred embodiment of a configuration according to the invention.

In a further alternative embodiment as shown in FIG. 2, a thermally conductive device is provided in the form of a cooling-medium tank 52. The crankcase 18 is dipped into the cooling medium tank. In this case, the dipping tracks (arrow 58) the advance of the coating device 10, in such a manner that a cooling-medium level 54 is always at a constant, given distance 56 of, for example, 20 mm from the coating zone 28. In this embodiment, therefore, heat is dissipated by dip-cooling or immersion cooling of the crankcase 18.

According to the invention, the three cooling options described above can be used as alternatives or in any desired combination with one another in a single configuration according to the invention.

Furthermore, in a preferred refinement of the invention, it is provided that, during the coating of the cylinder bearing surface 14 with the plasma beam 12 or a laser beam, a cooling fluid, such as for example gas, nitrogen or a cooling liquid, is passed through the water chamber 26. This results in a further cooling of the cylinder wall 15 and therefore in an additional dissipation of heat from the coating zone.

We claim:

1. A configuration for producing a wear-resistant surface on a crankcase, comprising:

a thermally conductive device configured to be disposed in a thermally conductive contact with a crankcase formed of an AlSi alloy;

said thermally conductive device being configured to operate with a cooling medium;

a surface treatment device configured to treat a surface of the crankcase;

said thermally conductive device having at least one cooling plate configured to be disposed on at least one side of the crankcase having cylinder openings formed on the at least one side; and said at least one cooling plate being formed with channels for the cooling medium to flow therethrough.

2. The configuration according to claim 1, wherein said thermally conductive device is configured to operate with a fluid as the cooling medium, the fluid is selected from the group consisting of a gas and a cooling liquid.

3. The configuration according to claim 1, wherein said thermally conductive device is configured to operate with nitrogen as the cooling medium.

4. The configuration according to claim 1, wherein:

said thermally conductive device has at least one annular cooling plate configured to be disposed along a circumferential edge of a cylinder bore of the crankcase and aligned with the cylinder bore; and said at least one annular cooling plate is formed with channels for the cooling medium to flow therethrough.

5. A configuration for producing a wear-resistant surface on a crankcase, comprising:

a thermally conductive device configured to be disposed in a thermally conductive contact with a cylinder bearing surface of a cylinder in a crankcase formed of an AlSi alloy;

said thermally conductive device being configured to operate with a cooling medium;

a surface treatment device configured to treat a surface of the crankcase;

said thermally conductive device including at least one cooling mandrel formed to correspond to a cross section of the cylinder and configured to be disposed in the cylinder on at least one side of a coating zone of the cylinder bearing surface such that the thermally conductive contact is formed between said at least one cooling mandrel and the cylinder bearing surface; and said at least one cooling mandrel being formed with passages for the cooling medium to flow therethrough.

6. The configuration according to claim 5, wherein said passages are helically encircling passages.

7. The configuration according to claim 5, wherein:

said at least one cooling mandrel is configured to be disposed, with respect to a direction of gravity, beneath the coating zone; and said at least one cooling mandrel has a collection basin for receiving excess coating material.

8. The configuration according to claim 7, wherein:

said at least one cooling mandrel has a peripheral region with a side facing the coating zone; and said at least one cooling mandrel has a collection lug disposed on the side of said peripheral region facing the coating zone.

9. The configuration according to claim 5, wherein:

said at least one cooling mandrel has a peripheral region facing the cylinder bearing surface; and said at least one cooling mandrel has cooling bristles disposed at said peripheral region and configured to be in brushing contact with the cylinder bearing surface.

10. The configuration according to claim 9, wherein said cooling bristles are made of a thermally conductive material.

11. The configuration according to claim 9, wherein said cooling bristles are copper bristles.

12. In combination with a crankcase having a cylinder with a cylinder bearing surface, the crankcase having a side formed with a cylinder opening, and the crankcase being formed of an AlSi alloy, a configuration for treating the crankcase, comprising;

a thermally conductive device including a cooling medium;

said thermally conductive device being in a thermally conductive contact with the crankcase formed of AlSi alloy;

said thermally conductive device having a cooling plate disposed on the side formed with the cylinder opening; and said cooling plate being formed with channels for said cooling medium to flow therethrough.

13. The configuration according to claim 12, wherein said cooling medium is a fluid selected from the group consisting of a gas and a cooling liquid.

14. The configuration according to claim 12, wherein:

the cylinder is formed with a cylinder bore having a circumferential edge; and said cooling plate is an annular cooling plate disposed along the circumferential edge and aligned with the cylinder bore.

15. In combination with a crankcase having a cylinder with a cylinder bearing surface and a coating zone on the cylinder bearing surface, the cylinder having a cross section and the crankcase being formed of AlSi alloy, a configuration for treating the crankcase, comprising:

a thermally conductive device including a cooling medium;

said thermally conductive device being in a thermally conductive contact with the crankcase formed of AlSi alloy;

said thermally conductive device including a cooling mandrel formed to correspond to the cross section of the cylinder;

said cooling mandrel being disposed in the cylinder on at least one side of the coating zone such that the thermally conductive contact is formed between said cooling mandrel and the cylinder bearing surface; and said cooling mandrel being formed with passage for said cooling medium to flow therethrough.

16. The configuration according to claim 15, wherein said passages are helical passages.

17. The configuration according to claim 15, wherein:

said cooling mandrel is disposed, with respect to a direction of gravity, beneath the coating zone; and said cooling mandrel has a collection basin for receiving excess coating material.

18. The configuration according to claim 15, wherein:

said cooling mandrel has a peripheral region with a side facing the coating zone; and said cooling mandrel has a collection lug disposed on the side of said peripheral region facing the coating zone.

19. The configuration according to claim 15, wherein:

said cooling mandrel has a peripheral region facing the cylinder bearing surface; and said cooling mandrel has cooling bristles disposed at said peripheral region; and said cooling bristles are in brushing contact with the cylinder bearing surface.

20. The configuration according to claim 19, wherein said cooling bristles are made of a thermally conductive material.

21. The configuration according to claim 19, wherein said cooling bristles are copper bristles.

22. In combination with a component having a coating zone and being formed of AlSi alloy, a configuration for treating the component, comprising;

a thermally conductive device including a cooling medium;

said thermally conductive device being in a thermally conductive contact with the component formed of AlSi alloy;

said thermally conductive device including a cooling-medium tank filled with said cooling medium up to a cooling medium level; and component being dipped into said cooling medium such that a given distance between the cooling medium level and the coating zone is maintained.

* * * * *